United States Patent [19]

Dubarko

[11] Patent Number: 4,600,255

[45] Date of Patent: Jul. 15, 1986

[54] LATCH AND DETENT MECHANISM FOR SLIDING TRAY

[75] Inventor: Donald L. Dubarko, Beaverton, Oreg.

[73] Assignee: Tektronix, Inc., Beaverton, Oreg.

[21] Appl. No.: 593,163

[22] Filed: Mar. 26, 1984

[51] Int. Cl.[4] ..... A47B 88/16

[52] U.S. Cl. ..... 312/333; 108/143; 292/209; 312/122; 312/348

[58] Field of Search ..... 312/12, 119, 333, 348, 312/350, 122; 108/143; 308/3.6; 292/202, 252, DIG. 46, DIG. 47, 209

[56] References Cited

U.S. PATENT DOCUMENTS

| | | | |
|---|---|---|---|
| 539,662 | 5/1895 | Beckwith | 312/348 |
| 1,508,259 | 9/1924 | Stafford | 312/348 X |
| 1,556,593 | 10/1925 | Eklind et al. | 292/DIG. 46 |
| 1,557,140 | 10/1925 | Clarkson | 292/202 |
| 1,597,837 | 8/1926 | Staley | 292/DIG. 46 |
| 1,995,640 | 3/1935 | Hess et al. | 312/333 X |
| 2,010,633 | 8/1935 | Heath | 108/143 |
| 2,498,243 | 2/1950 | Brinker et al. | 312/333 X |
| 2,730,423 | 1/1956 | Mock | 312/348 |
| 2,743,149 | 4/1956 | Abrahamson et al. | 312/348 X |
| 2,924,476 | 2/1960 | Deane | 292/209 |
| 3,027,202 | 3/1962 | Gottfried et al. | 308/3.6 |
| 3,142,517 | 7/1964 | Ward | 312/348 X |
| 3,238,003 | 3/1966 | Stark | 312/333 X |
| 4,463,976 | 8/1984 | Douglas | 292/202 |
| 4,482,066 | 11/1984 | Dykstra | 312/348 X |
| 4,496,200 | 1/1985 | Hagstrom et al. | 108/143 X |

FOREIGN PATENT DOCUMENTS

| | | | |
|---|---|---|---|
| 206846 | 2/1909 | Fed. Rep. of Germany | 312/348 |
| 1234953 | 2/1967 | Fed. Rep. of Germany | 312/348 |
| 60328 | 11/1954 | France | 312/348 |

*Primary Examiner*—William E. Lyddane
*Assistant Examiner*—Thomas A. Rendos
*Attorney, Agent, or Firm*—Allston L. Jones; Robert S. Hulse

[57] ABSTRACT

A latch and detent mechanism for use with a sliding tray 12 mounted in a cabinet 10 is disclosed. The mechanism includes a stationary detent bar 18 having one or more detent slots 22, a latch bar 20 that is pivotably coupled to the sliding tray with a finger 46 at one end for engaging a detent slot to lock the tray in position and a handle 14 at the other end for disengaging the finger to unlock the tray, and biasing means 54 for urging the finger toward the detent slot.

3 Claims, 12 Drawing Figures

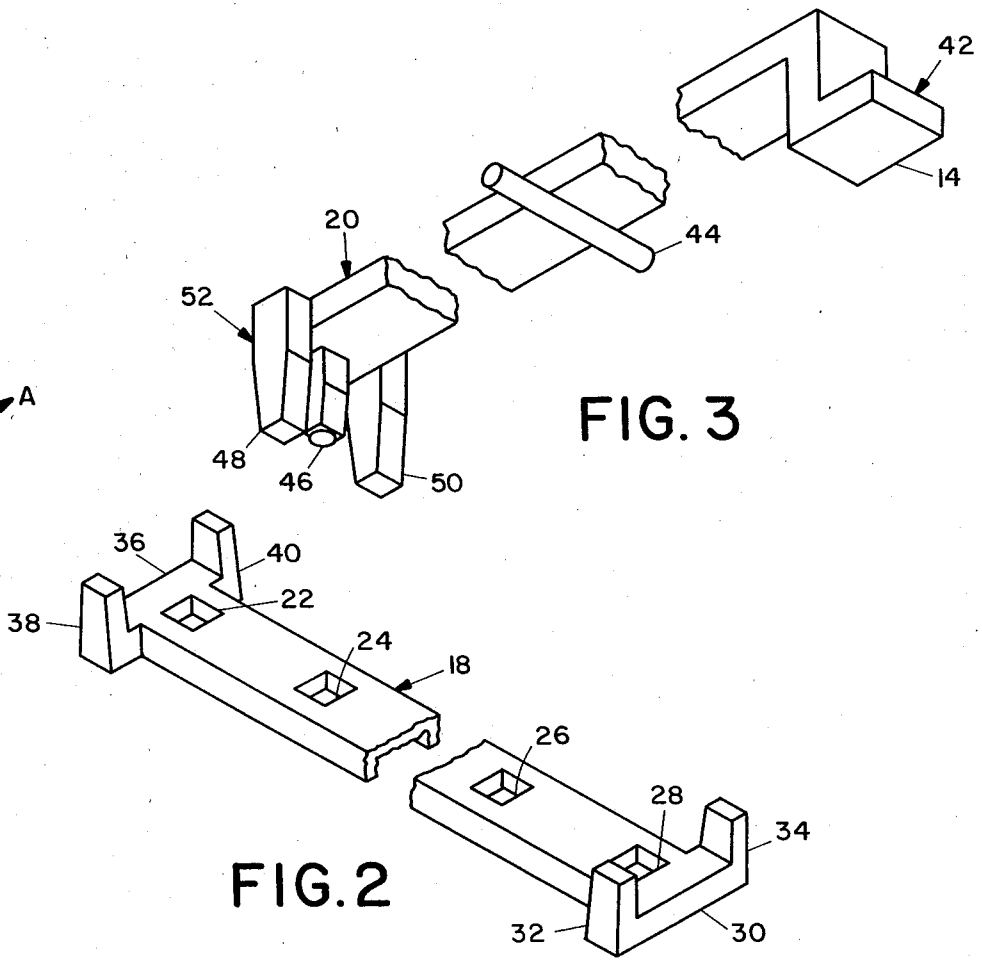
FIG. 3
FIG. 2
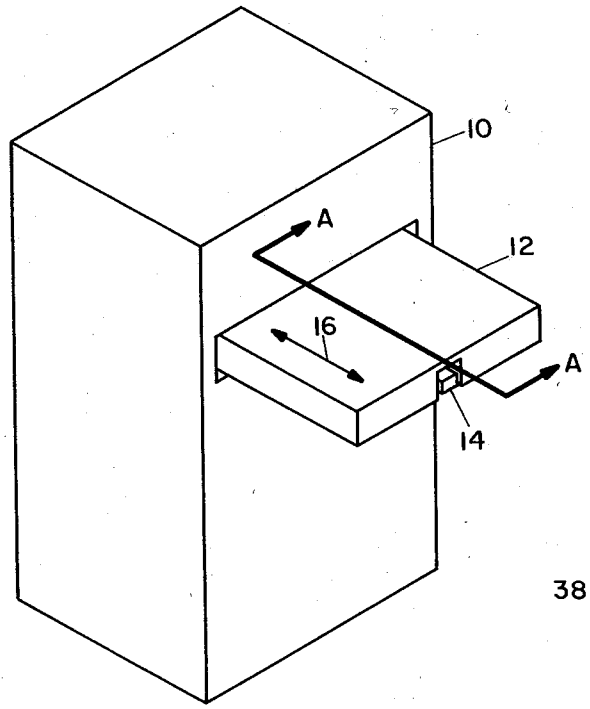
FIG. 1

LATCH AND DETENT MECHANISM FOR SLIDING TRAY

BACKGROUND OF THE INVENTION

1. Field of the Invention

This invention relates generally to slide mechanisms for drawers and trays, and relates more particularly to a latch and detent mechanism for use with a sliding tray.

2. Description of the Prior Art

Sliding trays are useful for a variety of purposes. One use for sliding trays is in computer console cabinets, where a sliding tray may be used to provide a horizontal work surface for the placement of a keyboard and work materials. When the computer is in use, the sliding tray is extended from the cabinet and is locked into position. It is desirable to lock the sliding tray in its extended position to prevent inadvertent retraction. When the computer is not in use, the sliding tray is retracted into the cabinet to save floor space. It is also desirable to lock the sliding tray in its retracted position to prevent extension during shipping and handling. Other locked positions intermediate to the fully extended and fully retracted positions are also useful to allow the user to extend and lock the sliding tray to the position best suited for his or her environment.

Sliding trays with locking, mechanisms have been known in the prior art. They have typically included a tray mounted on drawer slides with locking provided by a mechanism coupled to the drawer slides. Such sliding trays were expensive due to the complexity of the locking mechanisms. Many such sliding trays were capable of locking only at the fully extended position. They were difficult to unlock where the drawer slides had been hidden from sight to improve visual appearances. In addition, they suffered from lack of rigidity due to backlash in the locking mechanisms.

SUMMARY OF THE INVENTION

In accordance with the illustrated preferred embodiment, the present invention provides a latch and detent mechanism for use with a sliding tray mounted in a cabinet. The mechanism includes a stationary detent bar having one or more detent slots, a latch bar that is pivotably coupled to the sliding tray with a finger at one end for engaging a detent slot to lock the tray in position, handle means coupled to the latch bar for disengaging the finger to unlock the tray, and biasing means for urging the finger toward the detent slot.

In the preferred embodiment, the invention includes two molded plastic parts plus a coil spring. Both the detent bar and the latch bar are positioned beneath the tray with their axes parallel to the direction of tray movement. A pivot pin located near the center of the latch bar is coupled to the underside of the tray to provide a pivotable mounting for the latch bar. The finger of the latch bar is disposed toward the aft end of the tray and a handle is disposed toward the forward end. The coil spring is placed between the latch bar and the tray at a position between the finger and the pivot pin. The coil spring forces the finger downward into a detent slot to lock the position of the tray. To reposition the tray, the handle end of the latch bar is forced downward, which lifts the finger from the detent slot and unlocks the tray.

The preferred embodiment also includes stops for defining the fully extended and fully retracted positions of the tray. The detent bar includes forward and aft stop members, and the latch bar includes a stop member as well. The stop member of the latch bar contacts the forward stop member of the detent bar at the fully extended position, and it contacts the aft stop member at the fully retracted position. Detent slots are provided to lock the tray at both the fully extended and the fully retracted positions.

Backlash is avoided by the use of detent slots with two tapered side walls and a finger with two correspondingly tapered faces. When the finger is engaged with a detent slot, the coil spring ensures intimate contact between the walls of the detent slot and the faces of the finger.

The latch and detent mechanism of the present invention provides several advantages over other prior art mechanisms. A major advantage is low cost, since the invention consists of two molded plastic parts and a standard coil spring. A further advantage is that several locking positions for the tray are provided. Another advantage is that backlash is eliminated to provide stability at each of the several locking positions. Still another advantage is that the latch and detent mechanism of the present invention and the drawer slides of the tray are positioned beneath the tray, thereby presenting a pleasing visual appearance.

BRIEF DESCRIPTION OF THE DRAWINGS

FIG. 1 is a perspective view of a cabinet with a sliding tray that incorporates a latch and detent mechanism according to the present invention.

FIG. 2 is a top perspective view of a detent bar of the latch and detent mechanism of the present invention.

FIG. 3 is a bottom perspective view of a latch bar of the latch and detent mechanism of the present invention.

FIG. 4 shows the sliding tray in a retracted position.

FIG. 5 shows the sliding tray in an extended position.

DETAILED DESCRIPTION OF THE PREFERRED EMBODIMENT

Figure 8:
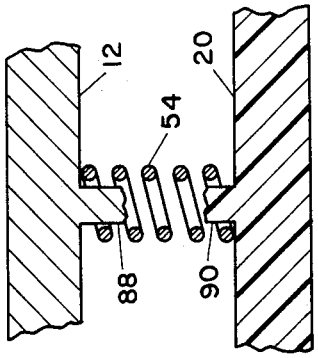
FIG. 8 is a front elevation sectional view of a coil spring, and is taken along section line D—D shown in FIG. 4.

The preferred embodiment of the present invention is a latch and detent mechanism for use with a sliding tray. FIG. 1 shows a cabinet 10 with a sliding tray 12 in an extended position. The tray includes a handle 14 that is pushed downward to unlock the tray for movement along direction 16 to another position. A pair of drawer slides and a latch and detent mechanism are coupled to the underside of tray 12, as will be described below. The drawer slides support and guide the tray between the extended position shown in FIG. 1 and a retracted position with the tray retracted into the cabinet. The latch and detent mechanism provides means for locking the tray at any of several locking positions. Cabinet 10 could be used, for example, as a computer console cabinet, with a keyboard positioned on the tray and a computer terminal or monitor positioned on top of the cabinet.

The latch and detent mechanism includes a detent bar 18 and a latch bar 20, shown, respectively, in FIGS. 2 and 3. Latch bar 20 is pivotably coupled to the underside of tray 12. Detent bar 18 is positioned beneath the latch bar, and is fixedly mounted to the cabinet. The axes of both detent bar 18 and latch bar 20 are oriented parallel to direction 16.

Detent bar 18 is generally elongate in shape with one or more detent slots 22, 24, 26, and 28 disposed at spaced apart positions along its axis. At a forward end 30 of the detent bar, shoulders 32 and 34 form a first stop member, and at an aft end 36, shoulders 38 and 40 form a second stop member. Forward end 30 is oriented toward the front of cabinet 10, while aft end 36 is oriented toward the rear of the cabinet.

Latch bar 20 is also generally elongate in shape. Handle 14 is disposed at forwad end 42 of the latch bar. A pivot pin 44 is transversely oriented to the axis of the latch bar and is affixed near the center of the latch bar. Three downward-pointing fingers 46, 48, and 50 are disposed at aft end 52 of the latch bar.

Figure 4:
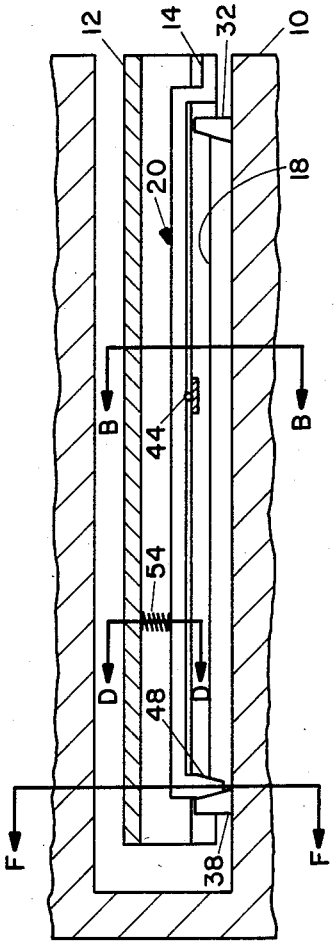
FIG. 4 is side elevation sectional view of the sliding tray and the latch and detent mechanism, and is taken along section line A—A shown in FIG. 1.
Figure 5:
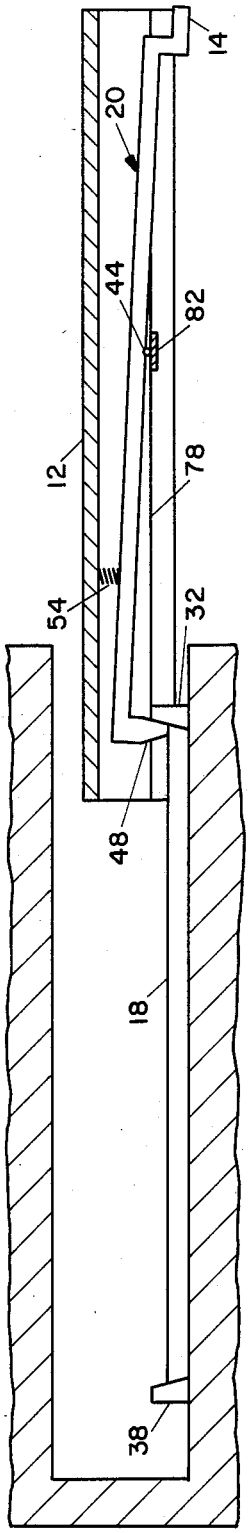
FIG. 5 is side elevation sectional view of the sliding tray and the latch and detent mechanism, and is taken along section line A—A shown in FIG. 1.

Turning now to FIGS. 4 and 5, the relative positioning of tray 12, detent bar 18, and latch bar 20 may be seen. In FIG. 4, the tray is shown in its fully retracted position. At the fully retracted position, second and third fingers 48 and 50 respectively contact shoulders 38 and 40. This aligns first finger 46 with respect to detent slot 22 (shown in FIG. 2). A coil spring 54, which is located between the latch bar and the tray at a position between the fingers and pivot pin 44, provides a downward force on the first finger. This downward force causes the first finger to enter into and engage detent slot 22. When the finger has engaged a detent slot, the tray is in a locked position.

In FIG. 5, the tray is shown in its fully extended position. To release the tray from the locked position shown in FIG. 4, a downward force is applied to handle 14. The downward force causes the latch bar to pivot about pivot pin 44, which compresses coil spring 54 and lifts the first finger 46 from the detent slot. With the first finger disengaged from the detent slot, the tray may be pulled forward until fingers 48 and 50 contact shoulders 32 and 34. This position is shown in FIG. 5. When the downward force on handle 14 is released, the first finger will engage detent slot 28 to lock the tray in the fully extended position.

Figure 6:
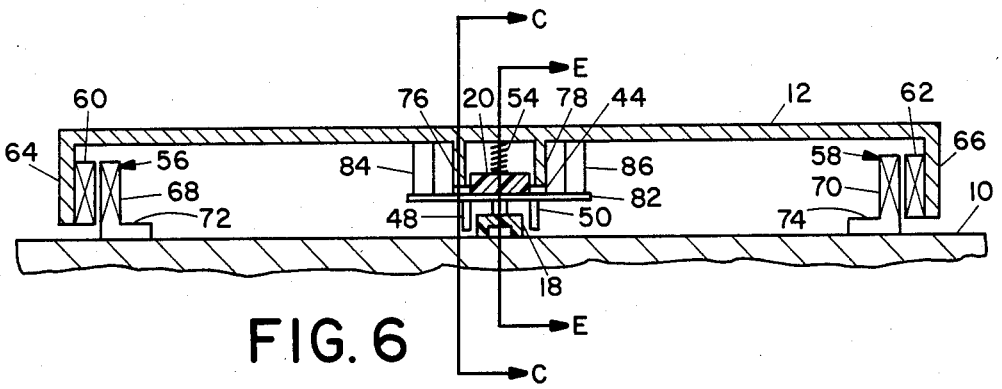
FIG. 6 is a front elevation sectional view of the sliding tray and the latch and detent mechanism, and is taken along section line B—B shown in FIG. 4.
Figure 9A:
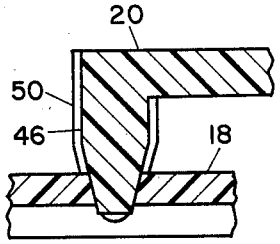
FIGS. 9*a*, 9*b*, and 9*c* are side elevation sectional views of a finger of the latch bar of FIG. 3 and a detent slot of the detent bar of FIG. 2, and are taken along section line E—E shown in FIG. 6.
Figure 9B:
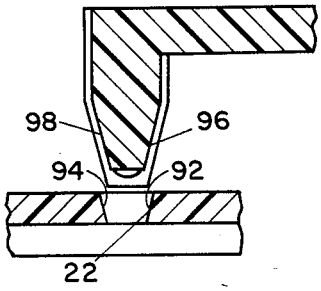
Figure 9C:
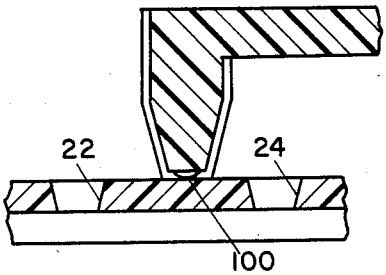

Details of mounting provisions for the latch and detent mechanism and the tray are shown in FIG. 6. Two drawer slides 56 and 58 are provided to couple tray 12 to cabinet 10. Runners 60 and 62 of drawer slides 56 and 58 are respectively affixed to the inner walls of vertical sides 64 and 66 of the tray. Frames 68 and 70 of drawer slides 56 and 58 are affixed to the cabinet by brackets 72 and 74. This provides a slidable coupling between the tray and the cabinet that is hidden from view.

Figure 7:
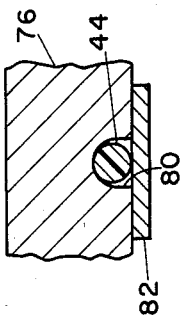
FIG. 7 is a side elevation sectional view of a pivot pin of the latch bar of FIG. 3, and is taken along section line C—C shown in FIG. 6.

Mounting provisions for latch bar 20 are shown in FIGS. 6 and 7. Two ribs 76 and 78 extend from the forward to the aft end of the tray and flank the latch bar. A notch 80 (FIG. 7) is provided at adjacent locations in each rib. Pivot pin 44 is placed in notch 80 and is retained by a plate 82. Plate 82 is secured to the underside of the tray by standoffs 84 and 86. There is sufficient clearance between the pivot pin and the notch and plate to permit the latch bar to pivot.

In FIG. 8, the mounting provisions for coil spring 54 are shown. The coil spring fits over a tab 88 that projects downward from the underside of tray 12, and a tab 90 that projects upward from the topside of latch bar 20. The coil spring is a helically wound compression spring that provides a downward force on the latch bar. Alternatively, biasing means could be provided by a tension spring located between pivot pin 44 and handle 14, or by a torsion spring located at the pivot pin.

In FIGS. *9a, 9b, 9c,* the engagement between first finger 46 and detent slot 22 is illustrated. Forward and aft side walls 92 and 94 of detent slot 22 are inwardly tapered and form a V-shaped slot. Forward and aft faces 96 and 98 of first finger 46 are tapered at the same angle as the side walls. When fully engaged, the faces of the first finger contact the side walls of the detent slot. Downward pressure exerted by the coil spring ensures contact between both forward and aft surfaces. Such contact eliminates backlash in the tray, and provides a stable locking position.

Selection of the angle of taper depends upon the amount of tray locking desired, as well as upon the material used for the latch bar. The amount of tray locking is determined by the taper angle and the downward force provided by the coil spring. If the tray is bumped, the finger will pop out of the detent slot if an upward force greater than the spring force is generated. A shallow taper angle will generate a greater upward force for a given horizontal force than will a steep taper angle. However, it is desirable for the finger to pop out of its detent slot instead of shearing off if the tray is struck with great force. In the preferred embodiment, the latch bar is composed of a molded plastic material, such as, for example, glass reinforced polystyrene. It has been found that a taper angle of ten to fifteen degrees provides a sufficient degree of tray locking while protecting the first finger from excessive shear forces.

In FIG. *9c,* the tip of the first finger is shown in contact with the upper surface of the detent bar. This happens when the tray is unlocked and moved, and the handle is then released. If the tray is moved either way, the finger will fall into a detent slot. A rounded tip 100 is provided at the tip of the first finger for contacting the surface of the detent bar. The rounded tip may be composed of a low friction material to reduce sliding friction and noise.

Figure 10:
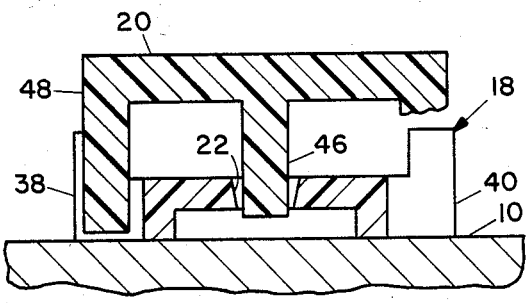
FIG. 10 is a front elevation sectional view of the latch bar and the detent bar, and is taken along section line F—F shown in FIG. 4.

Another view of an engaged first finger is shown in FIG. 10. Note that the lateral faces of first finger 46 are vertical, while the lateral side walls of detent slot 22 are tapered. Since tray backlash is eliminated by contact between the forward and aft tapered faces and side walls, the lateral faces and side walls need not contact. Clearance is provided between the lateral faces and side walls to facilitate engagement and retraction of the first finger.

From the above description, it will be apparent that the invention disclosed herein provides a novel and advantageous apparatus for a latch and detent mechanism for use with a sliding tray. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A latch and detent mechanism for a sliding tray situated in a cabinet comprising:

a detent bar fixedly mounted to said cabinet beneath said tray, said detent bar being essentially elongate and having a plurality of linearly disposed, spaced apart detent slots along the length of said detnet bar, said detent bar having a shoulder extending outward from at least one side of the detent bar at each end thereof, and each shoulder having an upwardly extending stop integral therewith;

a latch bar pivotably mounted to the underside of said tray, said latch bar being essentially elongate and being disposed parallel to said detent bar and parallel to the direction of movement of said tray, said latch bar having at one end a finger and a stop on at least one side with said finger disposed to engage said detent slots and said latch bar stop disposed to abut said detent bar stops when said tray is at its two extreme extents of motion, said finger and stop of said latch bar being spaced apart one from the other;

said detent slots each have four side walls with a first and a second of the side walls disposed transversely to the direction of tray movement, said first and second side walls being inwardly inclined with respect to the top of the detent bar to form a V-shaped slot, and wherein said finger has forward and aft faces that are inwardly inclined by an amount matching the first and second corresponding walls of said V-shaped slot, said forward and aft faces of the finger being disposed to contact said first and second walls of the slot when said finger is engaging one of said detent slots, the incline of the first and second side walls of the detent slots being selected to provide locking of the finger with the detent slot while at the same time allowing the finger to pop out of the detent slot under a force that is less than the shear force of the finger when the tray is struck:

means coupled to said latch bar for pivoting said latch bar to raise said finger from said detent slots for unlocking said tray; and means coupled between said tray and said latch bar for urging said finger into said detent slots.

2. A mechanism as recited in claim 1 wherein said finger includes low friction rounded tip means for reducing the sliding friction with said detent bar and the noise created when the finger is slid across the detent bar.

3. A mechanism as recited in claim 1 wherein the third and fourth side walls of the detent slots and the corresponding sides of the finger are spaced-apart from the other when the finger is engaging a detent slot.

* * * * *